US005669252A

United States Patent [19]

Bentley

[11] Patent Number: 5,669,252

[45] Date of Patent: Sep. 23, 1997

[54] COMBINATION SHOTGUN LOCK AND EJECTION PORT COVER ASSEMBLY

[76] Inventor: James K. Bentley, 2489 Starling Dr., Paso Robles, Calif. 93446-4703

[21] Appl. No.: 422,064

[22] Filed: Apr. 13, 1995

[51] Int. Cl.[6] ..... E05B 73/00

[52] U.S. Cl. ..... 70/14; 42/70.11; 42/70.04; 70/58

[58] Field of Search ..... 70/14, 57, 58, 70/63, 158, 163–169; 42/70.01–70.11

[56] References Cited

U.S. PATENT DOCUMENTS

| | | | |
|---|---|---|---|
| 2,742,726 | 4/1956 | Feller | 70/14 X |
| 3,018,576 | 1/1962 | Riechers | 42/70.11 |
| 3,089,272 | 5/1963 | McKinlay | 42/70.11 |
| 3,634,963 | 1/1972 | Hermann | 70/14 X |
| 4,896,447 | 1/1990 | Badoni | 42/96 X |
| 5,022,242 | 6/1991 | Povilaitis | 70/168 X |
| 5,220,815 | 6/1993 | Davidge et al. | 70/168 X |
| 5,241,769 | 9/1993 | Von Muller | 42/70.11 |
| 5,303,971 | 4/1994 | Johnsen et al. | 70/168 X |
| 5,331,759 | 7/1994 | Marceau et al. | 42/70.11 |
| 5,419,069 | 5/1995 | Mumbleau et al. | 42/70.11 |

*Primary Examiner*—Suzanne Dino

[57] ABSTRACT

A combination shotgun lock and ejection port cover assembly for use with a shotgun having an ejection port. The assembly has a block-shaped member having length and height dimensions that allow it to be inserted into the election port. A cover panel is connected to the block-shaped member and its length and height dimensions are greater than that of the block-shaped member so that the cover panel can not be pushed into the ejection port. A key lock cylinder is mounted in the cover panel and extends into the block-shaped member. A tang mounted on the key lock cylinder is rotatable up through a slot in the top wall of the block-shaped member to lock the assembly in place. When inserted into the ejection port, the assembly locks the action slide assembly of the shotgun and prevents it from being fired and also fuels the ejection port thereby preventing dirt and other debris from entry therein.

4 Claims, 2 Drawing Sheets

COMBINATION SHOTGUN LOCK AND EJECTION PORT COVER ASSEMBLY

BACKGROUND OF THE INVENTION

The invention relates to a lock assembly and more specifically to a combination shotgun lock and ejection port cover assembly for use with a shotgun.

When a shotgun is not being used or being stored it is usually the manufacturer's recommendation that the forearm be pulled rearwardly to insure that any shells that might be in the receiver are ejected. When this occurs the action slide assembly is also pulled rearwardly and the ejection port is exposed. A major problem in leaving the ejection port open is the fact that dust and other particles of matter can get into the interior of the receiver and also into the rear end of the gun barrel. Dirt or any other debris in the working mechanism of the shotgun is always undesirable.

Another major concern for the owner of a shotgun is preventing unauthorized use of the gun by either adults or children. This often requires that the shotgun be stored in a locked case or room.

It is an object of the invention to provide a novel combination shotgun lock and ejection port cover assembly that not only secures the shotgun from unauthorized use but also prevents dust and other debris from entering the ejection port while the shotgun is not in use.

It is also an object of the invention to provide a novel combination shotgun lock and ejection port cover assembly that can be easily and quickly installed and removed and to provide a secure lock for the shotgun when the assembly has been locked therein.

It is another object of the invention to provide a novel combination shotgun lock and ejection port cover assembly that is economical to manufacture and market.

It is a further object of the invention to provide a novel combination shotgun lock and ejection port cover assembly that is lightweight and can be made of plastic material.

It is an additional object of the invention to provide a novel combination shotgun lock and ejection port cover assembly that has structure which has to be inserted into the rear end of the gun barrel and the assembly can not be inserted into the shotgun unless the rear end of the gun barrel is free from shotgun shells.

SUMMARY OF THE INVENTION

The novel combination shotgun lock and ejection port cover assembly has been designed to be used with pump shotguns, automatic shotguns and semiautomatic shotguns. Each of these weapons have an ejection port in the right side wall of the receiver. The dimensions of the ejection port are such that it has a predetermined length L1 and a predetermined height H1.

The combination shotgun lock and ejection port cover assembly is dimensioned so that its block-shaped member has a length and height that is less than the length and height dimensions of the ejection port. This allows the combination shotgun lock and ejection port cover assembly to be inserted therein and the tit extending from the front wall of the block-shaped member is inserted into the rear end of the gun barrel.

When a key in the lock cylinder assembly is turned approximately 90 degrees to the right, the tang member is rotated upwardly and it will contact the interior wall of the receiver above the ejection port. This will cause the block-shaped member to be pushed downwardly causing the groove in the bottom wall thereof to engage the lower longitudinal edge of the ejection port. When the key has been turned to its locked position and removed, it is impossible to remove the combination shotgun lock and ejection port cover assembly.

The cover panel of the assembly has a length and height that are greater than the length and height of the ejection port to completely obscure it and eliminate any possibility of a screwdriver or knife or other type of device being wedged into the ejection port in an attempt to remove the combination shotgun lock and ejection port cover assembly.

DESCRIPTION OF THE PREFERRED EMBODIMENT

The novel combination shotgun lock and ejection port cover assembly will now be described by referring to FIGS. 1–8 of the drawings. The combination shotgun lock and ejection port cover assembly is generally designated numeral 10.

Figures 1, 2, 3, 4, 5, 6, 7, 8:
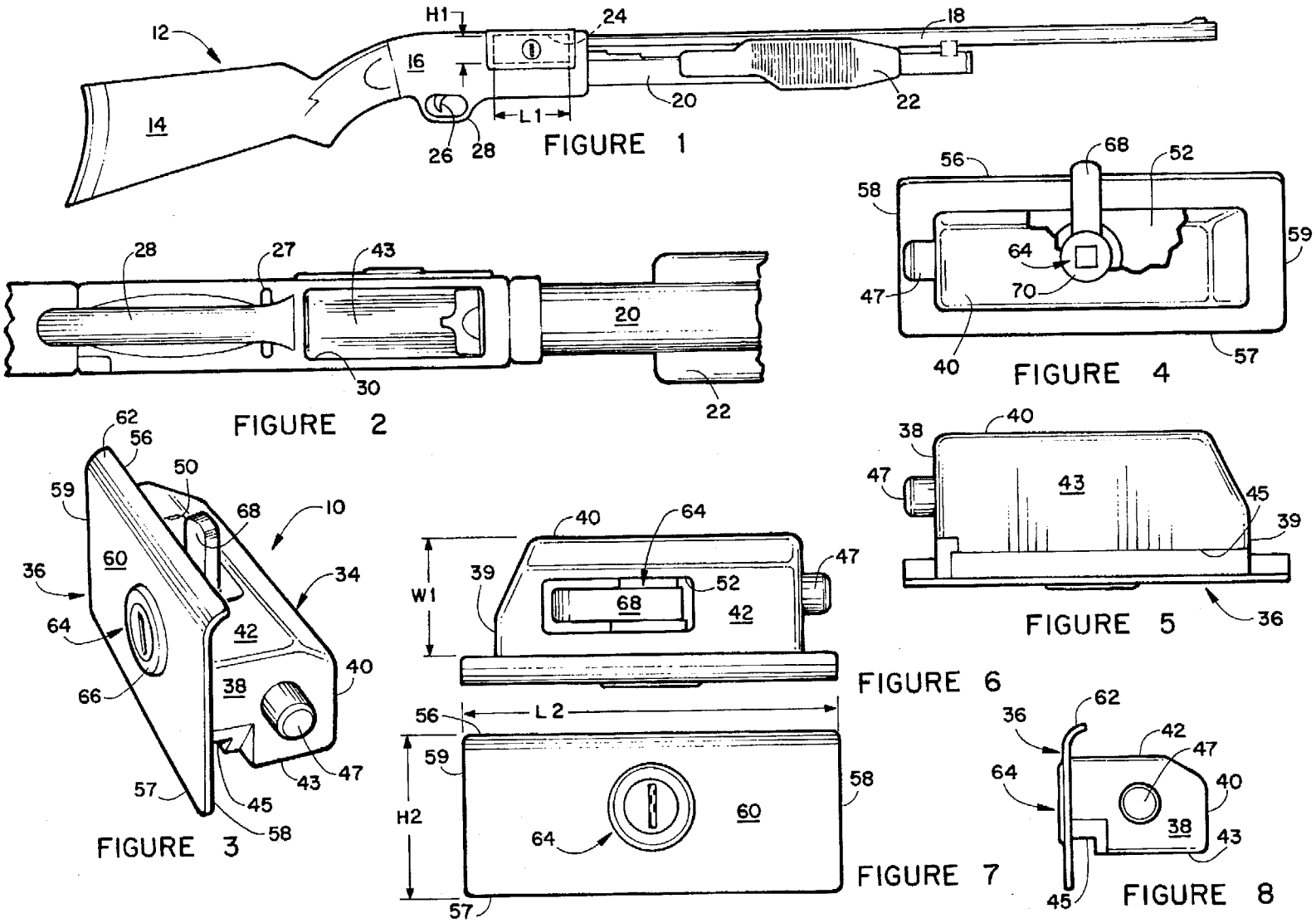
FIG. 1 is a side elevation view of a pump shotgun having an ejection port with applicant's novel combination shotgun lock and ejection port cover assembly inserted therein.
FIG. 2 is a partial bottom plan view of the pump action shotgun showing the bottom wall of the combination shotgun lock and ejection port cover assembly that is inserted therein.
FIG. 3 is a front perspective view of the novel combination shotgun lock and ejection port cover assembly.
FIG. 4 is a rear elevation view of the novel combination shotgun lock and ejection port cover assembly.
FIG. 5 is a bottom plan view of the novel combination shotgun lock and ejection port cover assembly.
FIG. 6 is a top plan view of the novel combination shotgun lock and ejection port cover assembly.
FIG. 7 is a front elevation view of the novel combination shotgun lock and ejection port cover assembly.
FIG. 8 is a right end elevation view of the novel combination shotgun lock and ejection port cover assembly.

Pump action shotgun 12 has a stock 14, a receiver 16, a gun barrel 18, a magazine 20, and a forearm 22. Receiver 16 has an ejection port 24 with the combination shotgun lock and ejection port cover assembly 10 inserted therein. A trigger 26, a safety button 27 and a trigger guard 28 also form a part of receiver 16. An action slide assembly (not shown) is attached to forearm 22 and it has laterally spaced fingers (not shown) that travel back into receiver 16. FIG. 2 shows the loading port 30 in the bottom of the receiver and shows the bottom wall 43 of the combination shotgun lock and ejection port cover assembly that has been inserted in ejection port 24. The ejection port has a length L1 and a height H1.

The specific structure of the combination shotgun lock and ejection port cover assembly is best illustrated in FIGS. 3–8. The major components of the device are block-shaped member 34 and cover panel 36. Block-shaped member 34 has a front wall 38, a rear wall 39, a right side wall 40 and a left side wall 41. There is also a top wall 42 and a bottom wall 43. Top wall 42 has a rear edge 42' and bottom wall 43 has a rear edge 43'. A groove 45 is formed in bottom wall 43 and it has an open left end and an open right end receives the bottom edge of the structure that defines ejection port 44. A tit 47 extends outwardly from right side wall 40 and it is of a size and length such that it will extend into the rear end of the gun barrel 18 as long as there isn't a shotgun shell in the end of the gun barrel.

Top wall 42 has a slot 50 formed therein that is in communication with lock cylinder chamber 52. Block-shaped member 34 has a depth D1.

Cover panel 36 is preferably formed integrally with block-shaped member 34. Normally it would be made of molded plastic material. Cover panel 36 has a top edge 56, a bottom edge 57, a right edge 58, a left edge 59, a front surface 60 and a rear surface 61. Cover panel 36 has a length L2 and a height H2 and these are greater than the length L1 and height L1 of the ejection port 24. A curved lip 62 is formed adjacent the top edge 56 and it conforms to the surface contour of the receiver 16.

Key lock cylinder assembly 64 extends through cover panel 36 with its rear end mounted in lock cylinder chamber 52. Lock cylinder assembly 64 has a flange 66 adjacent its front end and an elongated tang member 68 extends upwardly from the rear end of lock cylinder assembly 64 and through slot 50. Tang member 68 has a base 70 having a square aperture 73 that is mounted on the shank 74 of the lock cylinder assembly 64.

Figure 10:
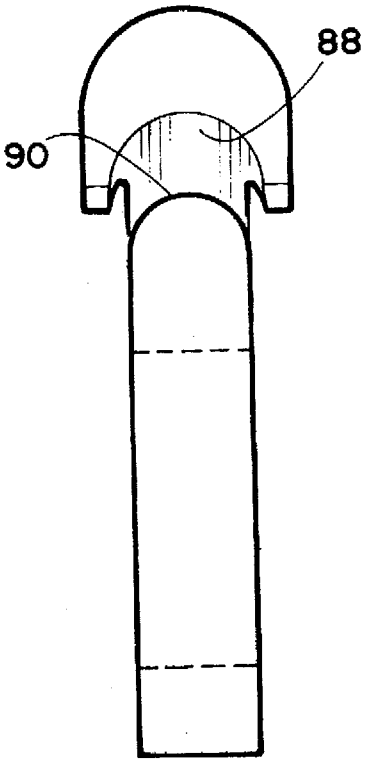
FIG. 10 is a side elevation view of the tang illustrated in FIG. 9.
Figure 9:
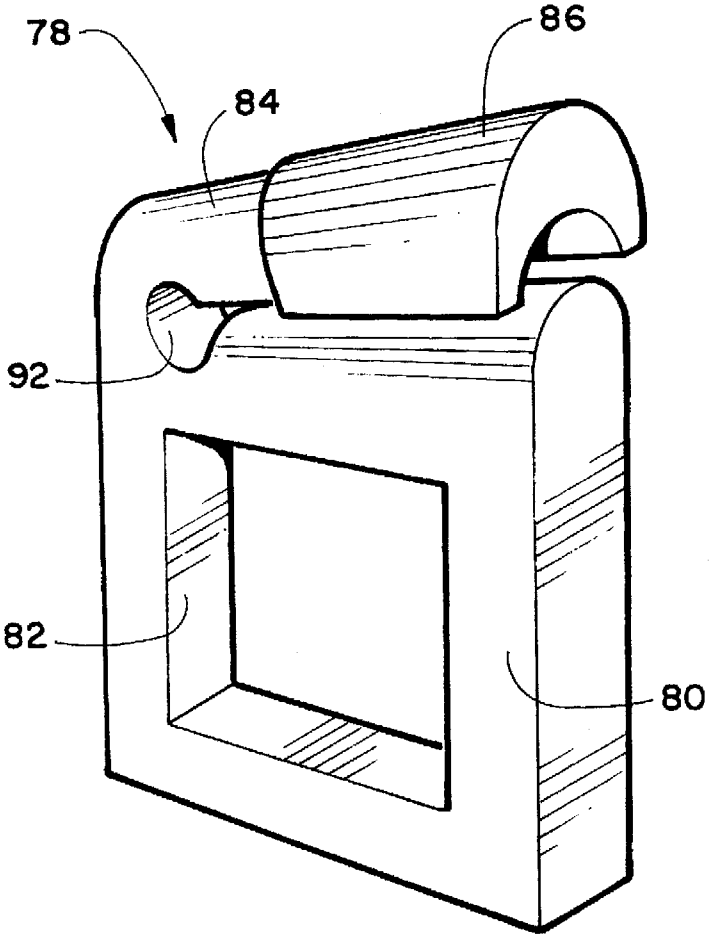
FIG. 9 is a front perspective view of an alternative embodiment for a tang to be mounted on the shank of the lock cylinder assembly.

The manner in which the combination shotgun lock and ejection port cover assembly is used will now be described. Assembly 10 is inserted into ejection port 24 with tit 47 aligned with the rear end of gun barrel 18. A key in lock cylinder assembly 64 is turned approximately 90 degrees rotating tang member 68 upwardly and out of slot 50. The top surface of tang member 68 will engage the inner surface of receiver 16 and as this occurs it will force block-shaped member downwardly so that groove 45 positively grips the bottom wall structure of the receiver that forms ejection port 24. Once locked in this position, the key is removed and it is impossible to remove the combination shotgun lock and ejection cover port assembly. An alternative tang member 78 is illustrated in FIGS. 9 and 10. It has a base 80 having a square aperture 82 that telescopically is mounted on the shank 74 of lock cylinder assembly 64. Tang member 78 has a finger portion 84 having an enlarged head 86. The bottom of finger portion 84 and head 86 have a concave surface 88 that receive the convex top surface 90 of base 80. Aperture 92 provides a relief structure that allows finger portion 84 to be depressed downwardly toward convex top surface 90.

What is claimed is:

1. A combination shotgun lock and ejection port cover assembly in combination with a shotgun having a receiver that has an ejection port having a predetermined length L1 and a predetermined height H1, said shotgun having a gun barrel having a rear end, and wherein said assembly comprises:

a solid plastic block-shaped member having a height less than H1 and a length less than L1, said block-shaped member having a front wall, a rear wall, a top wall having a rear edge, a bottom wall having a rear edge, a left side wall, and a right side wall; said rear wall being a continuous surface that extends from the rear edge of said top wall to the rear edge of said bottom wall; a slot is formed in said top wall and said slot is in communication with a lock cylinder chamber formed in said solid plastic block-shaped member;

a solid plastic cover panel having a top edge, a bottom edge, a left edge, a right edge, a front surface, a rear surface, a predetermined length L2 that is greater than L1, and a predetermined height H2 that is greater than H1; the rear surface of said cover panel being integrally connected to the front wall of said block- shaped member; a longitudinally extending slot having an open left end and an open right end formed along the entire length of the bottom wall of said block-shaped member adjacent the rear surface of said cover panel for receiving a bottom edge of a structure that defines the ejection port of said shotgun; and a key lock cylinder having a front end and a rear end; said key lock cylinder having a shank adjacent said rear end; said key lock cylinder extending through said cover panel and into the lock cylinder chamber formed in said block-shaped member; an elongated tang member having a top end and a bottom end, said bottom end having an aperture that receives the shank of said key lock cylinder; said tang being aligned with the slot in the top wall of said block-shaped member so that rotation of said key lock cylinder will cause the top end of said tang member to be rotated upwardly through said slot for positively locking said combination shotgun lock and ejection port cover assembly in the ejection port of said shotgun.

2. A combination shotgun lock and ejection port cover assembly as recited in claim 1 wherein the top edge of said cover panel has the shape of a curved lip that conforms to the curvature of said receiver of said shotgun.

3. A combination shotgun lock and ejection port cover assembly as recited in claim 1 further comprising a tit extending outwardly from the right side wall of said block shaped member and said tit is designed to align with the rear end of the gun barrel of said shotgun and said tit cannot be inserted therein if a shotgun shell is in the rear end of the gun barrel.

4. A combination shotgun lock and ejection port cover assembly in combination with a shotgun having a receiver that has an ejection port having a predetermined length L1 and a predetermined height H1, said shotgun having a gun barrel having a rear end, and wherein said assembly comprises:

a solid plastic block-shaped member having a height less than H1 and a length less than L1; said block-shaped member having a front wall, a rear wall, a top wall having a rear edge, a bottom wall having a rear edge, a left side wall, and a right side wall; said rear wall having a continuous surface that extends from the rear edge of said top wall to the rear edge of said bottom wall; a slot is formed in said top wall and said slot is in communication with a lock cylinder chamber formed in said solid plastic block-shaped member;

a solid plastic cover panel having a top edge, a bottom edge, a left edge, a right edge, a front surface, a rear surface, a predetermined length L2 that is greater than L1, and a predetermined height H2 that is greater than H1; the rear surface of said cover panel being integrally connected to the front wall of said block- shaped member; a longitudinally extending slot having an open left end and an open right end formed along the entire length of the bottom wall of said block-shaped member adjacent the rear surface of said cover panel for receiving a bottom edge of a structure that defines the ejection port of said shotgun; and a key lock cylinder having a front end and a rear end; said key lock cylinder having a shank adjacent said rear end;

said key lock cylinder extending through said cover panel and into the lock cylinder chamber formed in said block-shaped member; an elongated tang member having a top end and a bottom end, said bottom end having a base having an aperture that receives the shank of said key lock cylinder; said tang having an elongated flexible finger portion connected to said top end that extends laterally across said top end and is spaced vertically from said base so that it can be depressed downwardly; said tang member being aligned with the slot in the top wall of said block-shaped member so that rotation of said key lock cylinder will cause the top end of said tang member to be rotated upwardly through said slot for positively locking said combination shotgun lock and ejection port cover assembly in the ejection port of said shotgun.

* * * * *